United States Patent [19]

Shaughnessy

[11] Patent Number: 4,875,310

[45] Date of Patent: Oct. 24, 1989

[54] MODULAR BUILDING

[76] Inventor: Ernest P. Shaughnessy, 507 14th Ave. North, Nampa, Id. 83605

[21] Appl. No.: 346,313

[22] Filed: May 1, 1989

Related U.S. Application Data

[63] Continuation-in-part of Ser. No. 190,467, May 5, 1988, abandoned.

[51] Int. Cl.[4] ..... E04B 1/32

[52] U.S. Cl. ..... 52/81; 52/DIG. 10

[58] Field of Search ..... 52/DIG. 10, 79.4, 81

[56] References Cited

U.S. PATENT DOCUMENTS

| | | | |
|---|---|---|---|
| 3,785,096 | 1/1974 | Neuhardt | 52/79.4 |
| 3,854,255 | 12/1974 | Baker | 52/DIG. 10 |
| 4,364,207 | 12/1982 | Bergman | 52/DIG. 10 |

FOREIGN PATENT DOCUMENTS

| | | | |
|---|---|---|---|
| 82614 | 12/1956 | Denmark | 52/DIG. 10 |
| 3404935 | 2/1985 | Fed. Rep. of Germany | 52/DIG. 10 |
| 2414104 | 9/1979 | France | 52/DIG. 10 |

*Primary Examiner*—Henry E. Raduazo

*Attorney, Agent, or Firm*—Frank J. Dykas; Craig M. Korfanta

[57] ABSTRACT

Eight and ten sided irregular polyhedron building structures which are particularly well suited to be manufactured on an automated continuous production and manufacturing line. Both building structures are manufactured from planar building panels each having a uniform width. The panels are further designed having face angles such that during manufacture a single top or bottom edge cut results in forming two edges, one on the preceding panel and one on the subsequent panel.

2 Claims, 9 Drawing Sheets

MODULAR BUILDING

This is a continuation in part of application Ser. No. 07/190,467, filed on 05/05/88.

BACKGROUND OF THE INVENTION

1. Technical Field.

This invention relates to a modular building design and more particularly to a modular building design utilizing trapezoidal building panels of uniform width for use with or without perimeter frames.

2. Background Art.

A variety of building designs utilizing prefabricated exterior panels have been developed over the years. The object in each case is to provide a building structure enclosing a large volume of usable space without any interference from internal frame members. This is usually accomplished by incorporating some aspect of a geodesic dome type of design which utilizes the concept of great circles as the basis for the perimeter structure framing.

TSCHUDY, ET AL., U.S.Pat. No. 4,480,414, teaches a hexagonal housing unit erected from a minimum of three differently shaped panels. At least two of the panels are of non-standard shape, that is panels with non-parallel sides. GROSSER, ET AL., U.S. Pat. No. 3,945,160 and GERSIN, Patent No. 3,230,673, both teach modular building structures constructed from triangular panels and generally require extensive support frame work and jointing hardware. The complicated jointing hardware is especially prominent and most easily seen in U.S. Pat. No. 3,945,160.

In each case the frame members are attached, one to the other based upon great circle intersections. The result is that while the structural loading of the perimeter frame may be theoretically efficient, it is not amenable to mass production, as it relates to erection techniques of fabrication using commonly available and preferred building materials. In particular, the fabrication of triangular shape panels by definition will result in significant waste of materials in the fabrication stages of construction since these materials are usually only available in standard widths and lengths designed for standard frame and sheeting construction practices.

A second problem concerns itself with the unfamiliarity of local craftman with that of the different construction techniques, and the difficulties associated therewith, in particular means and methods for measuring acute angles which vary from frame member to frame member such as is in U.S. Pat. No. 3,945,160.

The major problem with all of these is that they require exotic materials and/or excessive waste in materials when converting from standard sizes commonly available for use in conventional building techniques to the unconventional sizes required by the various modular designs.

What is needed is a modular building design which incorporates or maximizes the best features of the geodesic dome type of building design system with the usage of building materials readily available in standardized sizes such as 2×4 pre-cut lumber and 4×8 sheets of plywood or composite materials which are similar in design thereto.

It is anticipated that the building panels of the present invention will be manufactured using a continuous length process wherein the resulting panels all have a uniform width. Manufacturing panels of uniform width and standard shape, that is shapes with at least two parallel sides, provides for an economical and much less wasteful manufacturing process. Consequently, not only is ease of construction greatly enhanced, but the cost to the consumer is greatly reduced.

A second object is to maximize the most beneficial characteristics of readily available construction materials. Structures built in the United States today, in the case of tall structures in urban areas, are constructed of steel and concrete. Concrete is, of course, most useful as a structural material when placed under compressive load either by design or by prestressing. Steel is welded, bolted or riveted into a grid or framework from which other types of materials are used to enclose the structure.

For smaller structures such as residential homes and other structures having a height of no more than two or three stories, are oftentimes constructed of wood. Wood exhibits best structural compressive and tensile strengths along the grain as opposed to across it. As a result structural pre-cut lumber such as 2×4's and 2×6's and the like and withstand considerable loading length-wise, however laterally, the ability to withstand load is considerably diminished.

As a result if used in framing members for conventional traditional geodesic dome type construction, considerable care has to be made to insure that the wooden frame members have sufficient strength of materials to withstand the cross-grain loading inherent in these designs.

Accordingly, it is a object of this invention to provide a building panel design which automatically provides for vertical loading, along a traditional sense, of the perimeter frame so as to minimize or all-together eliminate any amount of materials needed to construct said frame.

DISCLOSURE OF INVENTION

These objects are accomplished by use of a conventional width building design which incorporates the features of and space efficiencies of geodesic type polyhedron enclosures with building panels which are trapezoidal in shape and are designed to utilize available conventional building materials of standardized sizes. In particular the invention provides for hemispherical polyhedron building structures six, eight and ten sided designs all of which utilize vertical trapezoidal side panels of uniform, equal width, wherein the parallel sides are vertically oriented and the side panels are connected, at the parallel edges, one to the other, to form a symmetrical enclosure of either six, eight or ten sides.

In the case of a ten sided irregular polyhedron structure, ten side panels, consisting of three small right handed trapezoidal shaped side panels, three small left handed trapezoidal shaped side panels, two large right handed trapezoidal shaped side panels, and two large left handed trapezoidal shaped side panels, are alternately joined together along parallel side edges to form a ten sided enclosure having interior dihedral angles of 144°. A series of closure panels, consisting of two right handed trapezoidal shaped closure panels, two left handed trapezoidal shaped closure panels and four rhombus shaped closure panels, are then joined to each other and the top edges of the side panels to complete the ten sided irregular polyhedron structure.

In the case of the eight sided irregular polyhedron structure, eight side panels consisting of three right handed trapezoidal shaped side panels, three left handed trapezoidal shaped side panels and two rectangular side panels, are alternately joined one to the other along parallel edges to form an eight sided enclosure having interior dihedral angles of 135°. A series of five closure panels, consisting of two left handed trapezoidal shaped closure panels, two right handed trapezoidal shaped closure panels and a rhombus shaped closure panels, are then joined one to the other and to the top edges of the side panels to complete the eight sided irregular polyhedron structure.

A distinguishing feature of the two aforementioned structures is that all of the panels are manufactured from a continuous width on an automated continuous production and manufacture line. The face angles and edge bevels are such that a single top or bottom edge cut actually forms two edges, one on the preceding panel and one on the succeeding panel. The production sequence is laid out such that a first set of building panels are cut one after the other in programmed sequence. The final top or bottom edge cut is also the first cut of the second sequence, i.e., a second irregular polyhedron building structure. The second set of panels is cut in a reverse order such that the cycle repeats itself every two panel sets.

The continuous production line has a continuous crowding radio frequency laminating press for continuously laminating, for instance, a first layer of exterior plywood siding to a second layer of two or four inch polystyrene insulation and in turn to a third layer of interior plywood or wall board. The laminated product is then fed into a continuous side cutter which trims the laminated panel stock to a uniform width and cuts any necessary side edge bevels. The uniform width stock is then fed through an automatic traveler double cut saw which is programmed to cut the first series of beveled top and bottom edges. The automatic traveler double cut saw can either travel along with the production flow, or the uniform width panel stock can be periodically stopped for cutting by an auto-stop indexing or registering system. The cut panels are then fed into a Bistronic or program controlled router for cutting doors, windows, skylights, or the like. Obviously, the program sequence of both the automatic traveler double cut saw and programmed controlled router are reversed every other sequence.

This building manufacturing process produces very little waste and results in a high quality prefabricated building structure which can be assembled in very little time which a minimum of tools. Additionally, the building structure requires no perimeter framing whatsoever, which reduces the cost to the consumer.

BEST MODE FOR CARRYING OUT INVENTION

Figure 1:
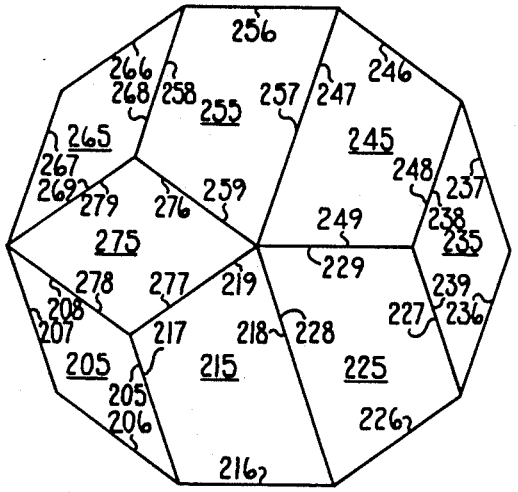
FIG. 1 is a top view of a ten sided irregular polyhedron building structure.
Figure 2:
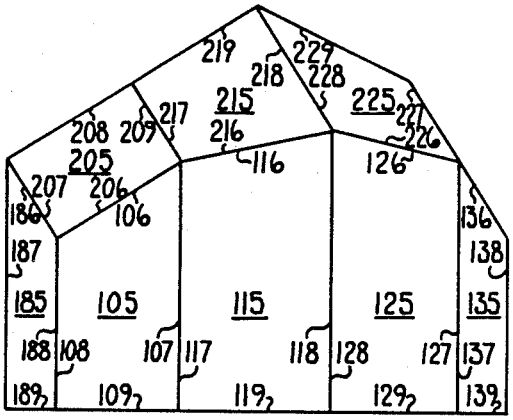
FIG. 2 is a side view of the ten sided irregular polyhedron building structure.
Figure 3:
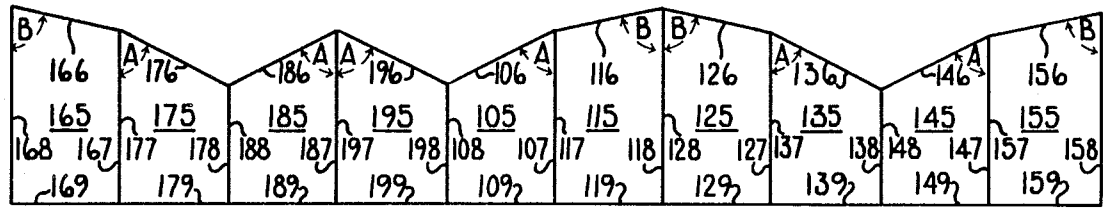
FIG. 3 is a layout plan view of the side panels for the ten sided irregular polyhedron building structure.
Figure 4:
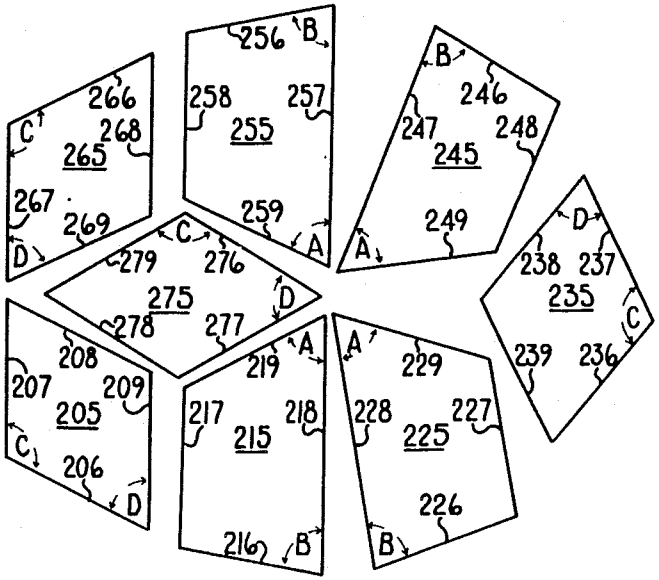
FIG. 4 is a layout plan view of the closure panels for the ten sided irregular polyhedron building structure.

Referring now to FIGS. 1–4, a ten sided irregular polyhedron building/structure 100 is shown. Ten sided irregular polyhedron building/structure 100 is generally constructed using eighteen building panels of a planar nature. Further, all of the building panels have at least two parallel edges separated by a uniform given width, say w. Advantageously, w is a standard building width of six, eight, ten or twelve feet. The panels are joined one to the other at their edges using lengths of angular metal, similar to the typical roof flashing but of heavier gauge. The angular metal lengths must be of heavy enough gauge material to demonstrate similar tensile strengths to that of the building panels.

The perimeter enclosure of the ten sided irregular polyhedron building/structure 100 is constructed of ten generally trapezoidal shaped side panels. A first small right handed trapezoidal shaped side panel 105, having a face angle, A, of 63.435°, a top inclined edge 106 of length T, a pair of parallel edges, right hand edge 107 of length Y and left hand edge 108 of length Z and a bottom perpendicular edge 109 of given width w separating parallel edges 107 and 108. A first large right handed trapezoidal shaped side panel 115 having a face angle, B, of 80.068°, a top inclined edge 116 of length t, a pair of parallel side edges, left hand edge 117 of length Y and right hand edge 118 of length X, and a bottom perpendicular edge 119 of given width w. First small right handed trapezoidal shaped side panel 105 is joined along its right hand edge 107 to the left hand edge 117 of first large right handed trapezoidal shaped side panel 115. The side panels are vertically disposed and joined such that the panels form a dihedral angle of 144°.

A first large left handed trapezoidal shaped side panel 125, having a face angle, B, of 80.068°, is joined along its left hand edge 128 of length X to the right hand edge 118 of first large right handed trapezoidal shaped side panel 115. First large left handed trapezoidal shaped side panel 125 has a top inclined edge 126 of length t, a right hand edge 127 of length Y and a bottom perpendicular edge 129 of given width w. A first small left handed trapezoidal shaped side panel 135, having a face angle, A, of 63.435° is joined along its left hand edge 137 of length Y to the right hand edge 127 of first large left handed trapezoidal shaped side panel 125 to form a 144° dihedral angle therewith. First small left handed trapezoidal shaped side panel 135 further has a top inclined edge 136 of length T, right hand edge 138 of length Z and a bottom perpendicular edge 139 of given width w.

A second small right handed trapezoidal shaped side panel 145 having a face angle, A, of 63.435° is joined along its left hand edge 148 of length Z to the right hand edge 138 of first small left handed trapezoidal shaped side panel 135, to form a 144° dihedral angle therewith. Second small right handed trapezoidal shaped side panel 145 has top inclined edge 146 of length T, right hand edge 147 of length Y, and bottom perpendicular edge 149 of given width w. A second large right handed trapezoidal shaped side panel 155, having a face angle, B, of 80.068°, is joined along its left hand edge 157 of length Y to the right hand edge 147 of second small right handed trapezoidal shaped side panel 145 to form a dihedral angle of 144° therewith. Second large right handed trapezoidal shaped side panel 155 has top inclined edge 156 of length t, right hand edge 158 of length X and a bottom perpendicular edge 159 of given width w.

A second large left handed trapezoidal shaped side panel 165, having a face angle, B, of 80.068°, is joined along its left hand edge 168 of length X to the right hand edge 158 of second large right handed trapezoidal shaped side panel 155 to form a 144° dihedral angle therewith. Second large left handed trapezoidal shaped side panel 165 further has a top inclined edge 166 of length t, right hand edge 167 of length Y and a bottom perpendicular edge 169 of given width w.

A second small left handed trapezoidal shaped side panel 175 is joined along its left hand edge 177 of length Y to the right hand edge 167 of second large left handed trapezoidal shaped side panel 165. Second small left handed trapezoidal shaped side panel 175 has a face angle, A, of 63.435°, a top inclined edge 176 of length T, a right hand edge 178 of length Z and a bottom perpendicular edge 179 of given width w. A third small right handed trapezoidal shaped side panel 185, having a face angle, A, of 63.435°, is joined along its left hand edge 188 of length Z to the right hand edge 178 of second small left handed trapezoidal shaped side panel 175. Third small right handed trapezoidal shaped side panel 185 has a top inclined edge 186 of length T, a right hand edge 187 of length Y and a bottom perpendicular edge 189 of given width w.

Finally, a third small left handed trapezoidal shaped side panel 195 having a face angle, A, of 63.435° is joined along its left hand edge 197 of length Y to the right hand edge 187 of third small right handed trapezoidal shaped side panel 185 and along its right hand edge 198 of length Z to the left hand edge 108 of first small right handed trapezoidal shaped side panel 105 to complete a ten sided perimeter enclosure having interior dihedral angles of 144°. Third small left handed trapezoidal shaped side panel 195 also has a top inclined edge 196 of length T and a bottom perpendicular edge 199 of given width w.

The roof of the ten sided irregular polyhedron building/structure 100 is constructed using two right handed trapezoidal shaped closure panels, two left handed trapezoidal shaped closure panels and four rhombus shaped closure panels. A first rhombus shaped closure panel 205 having a pair of opposing major face angles, C, of 116.565° and a pair of opposing minor face angles, D, of 63.435°, is joined along its first and second edges 206 and 207, both of length T, to the top inclined edges 106 and 196 of first small right handed trapezoidal shaped side panel 105 and third small left handed trapezoidal shaped side panel 195 respectively. A first right handed trapezoidal shaped closure panel 215 having a top face angle, A, of 63.435° and a bottom face angle, B, of 80.068° is next attached along its bottom inclined edge 216 of length t to the top inclined edge 116 of first large right handed trapezoidal shaped side panel 115. First right handed trapezoidal shaped closure panel 215 is also attached along its left hand edge 217 of length T to the fourth edge 209 of length T of a first rhombus shaped closure panel 205.

Next, a first left handed trapezoidal shaped closure panel 225 having a top face angle, A, of 63.435° and a bottom face angle, B, of 80.068° is attached along its bottom inclined edge 226 of length t to the top inclined edge 126 of first large left handed trapezoidal shaped side panel 125. First left handed trapezoidal shaped closure panel 225 is also attached along its left hand edge 228 of length V to the right hand edge 218 of length V of first right handed trapezoidal shaped closure panel 215. A second rhombus shaped closure panel 235 is next attached along its first and second edges 236 and 237, both of length T, to the top inclined edges 136 and 146 of first small left handed trapezoidal shaped side panel 135 and second small right handed trapezoidal shaped side panel 145. Analogously to first rhombus shaped closure panel 205, second rhombus shaped closure panel 235 has a pair of opposing major face angles, C, of 116.565° and a pair of opposing minor face angles, D, of 80.068°. Second rhombus shaped closure panel 235 is additionally attached along its fourth edge 239 of length T to the right hand edge 227 of length T of first left handed trapezoidal shaped closure panel 225.

A second right handed trapezoidal shaped closure panel 245 having a top face angle, A, of 63.435° and a bottom face angle, B, of 80.068° is attached along its bottom inclined edge 246 of lenght t to the top inclined edge 156 of second large right handed trapezoidal shaped side panel 155. Second right handed trapezoidal shaped closure panel 245 is also attached along its left hand edge 248 of length T to the third edge 238 of length T of second rhombus shaped closure panel 235, and along its top inclined edge 249 of length T to the top inclined edge 229 of length T of first left handed trapezoidal shaped closure panel 225. A second left handed trapezoidal shaped closure panel 255 having a top face angle, A, of 63.435° and a bottom face angle, B, of 80.068° is attached along its bottom inclined edge 256 of length t to the top inclined edge 166 of second large left handed trapezoidal shaped side panel 165. Second left handed trapezoidal shaped closure panel 255 is further attached along its left hand edge 257 of length V to the right hand edge 247 of length V of second right handed trapezoidal shaped closure panel 245.

A third rhombus shaped closure panel 265, again having a pair of opposing major angles, C, of 116.565° and a pair of opposing minor angles, D, of 63.435° is attached along first and second edges 266 and 267, both of length T, to the top inclined edges 176 and 186 of second small left handed trapezoidal shaped side panel 175 and third small right handed trapezoidal shaped side panel 185. Third rhombus shaped closure panel 265 is also attached along its third edge 268 to the right hand edge 258, both being of length T, of second left handed trapezoidal shaped closure panel 255.

A fourth and final rhombus shaped closure panel 275, again having a pair of opposing major face angles, C, of 116.565° and a pair of opposing minor face angles, D, of 63.435° is attached along its first and second edges 276 and 277, both of length T, to the top inclined edges 259 and 219, of second left handed trapezoidal shaped closure panel 255 and first right handed trapezoidal shaped closure panel 215. Fourth rhombus shaped closure panel 275 is further attached along its third and fourth edges 278 and 279, both of length T, to the third and fourth edges 208 and 269, both of length T, of the first and third rhombus shaped closure panels 205 and 265.

Figure 5:
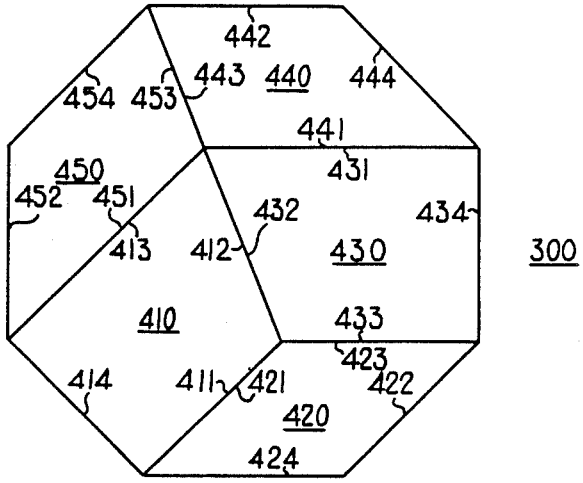
FIG. 5 is a top view of an eight sided irregular polyhedron building structure.
Figure 6:
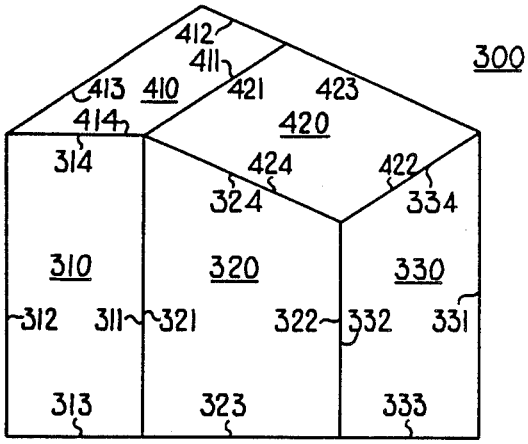
FIG. 6 is a side view of the eight sided irregular polyhedron building structure.
Figure 7:
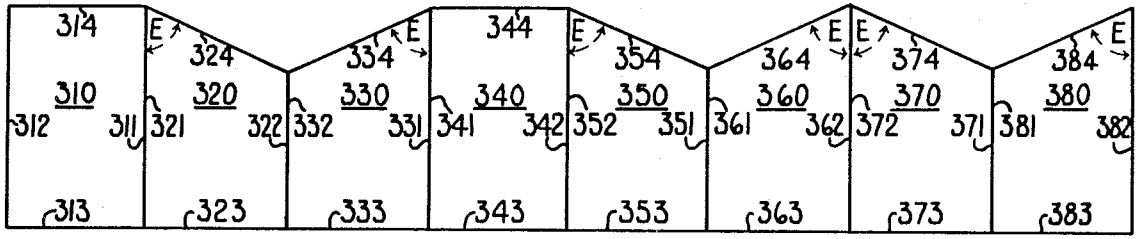
FIG. 7 is a layout plan view of the side panels for the eight sided irregular polyhedron building structure.
Figure 8:
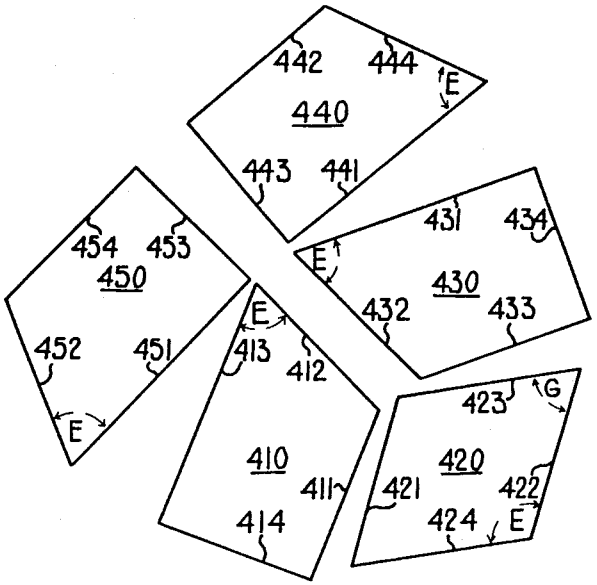
FIG. 8 is a layout plan view of the closure panels for the eight sided irregular polyhedron building structure.

Referring now to the FIGS. 5 through 7, an eight sided irregular polyhedron building/structure 300 is shown. As with the ten sided irregular polyhedron building/structure, the eight sided irregular polyhedron building/structure 300 is also particularly well suited for automated continuous production and manufacture. Eight sided irregular polyhedron building/structure 300 is generally constructed using thirteen (13) building panels of a planer nature. Further, all thirteen building panels have at least two parallel edges separated by a given width, here again denoted as w which is advantageously a standard width of 6, 8, 10, or 12 feet. The panels are joined one to the other along their edges using lengths of angular metal, similar to typical roof flashing but of heavier gauge. The angular metal links must be of heavy enough gauge material to demonstrate a similar tensile strength as that of the building panels.

The perimeter enclosure of the eight sided irregular polyhedron building/structure 300 is constructed of three right handed trapezoidall shaped side panels, three left handed trapezoidal shaped side panels and two rectangular shaped side panels. A first rectangular side panel 310, having right hand edge 311 of length L, left hand edge 312 of length L, and top and bottom edges 314 and 313 both of length w, is joined along right hand edge 311 to the left hand edge 321 of length L, of first left handed trapezoidal shaped side panel 320. The joint of right hand edge 311 and left hand edge 321 is formed such that first rectangular side panel 310 and first left handed trapezoidal shaped side panel 320 form a dihedral angle of 135°. First left handed trapezoidal shaped side panel 320 further has face angle, E, of 24.470°, a right hand edge 322 of length 1, a bottom edge 323 of length w and a top inclined edge 324 of length r.

A first right handed trapezoidal shaped side panel 330 is joined along its left hand edge 332 of length 1 to the right hand edge 322 of first left handed trapezoidal shaped side panel 320 to form a 135° dihedral angle therewith. First right handed trapezoidal shaped side panel 330 also has a face angle, E, of 24.470°, along with a right hand edge 331 of length L, a bottom edge 333 of length w and a top inclined edge 334 of length r. A second rectangular side panel 340 is joined along its left hand edge 342 of length L to the right hand edge 331 of first right handed trapezoidal shaped side panel 330. Second rectangular side panel 340 further has a left hand edge 342 of length L, a bottom edge 343 of length w and a top edge 344 also of length w.

A second left handed trapezoidal shaped side panel 350, again having a face angel, E, of 24.470° is joined along its left hand edge 352 of length L to the right hand edge 341 of second rectangular side panel 340. Second left handed trapezoidal shaped side panel 350 has a right hand edge 351 of length 1, a bottom edge 353 of length w and a top inclined edge 354 of length r. A second right handed trapezoidal shaped side panel 360 is joined along its left hand edge 361 of length 1 to the right hand edge 351 of second left handed trapezoidal shaped side panel 350. Second right handed trapezoidal shaped side panel 360 has a face angle, E, of 24.470°, a right hand edge 362 of length L, a bottom edge 363 of length w, and a top inclined edge 364 of length r.

A third left handed trapezoidal shaped side panel 370 is joined along its left hand edge 372 of length L to the right hand edge 362 of second right handed trapezoidal shaped side panel 360. Third left handed trapezoidal shaped side panel 370 has a face angle, E, of 24,470° a right hand edge 371 of length 1, a bottom edge 373 of length w, and a top inclined edge 374 of length r.

Finally, a third right trapezoidal shaped side panel 380 is joined along its left hand edge 381 of length 1 to the right hand edge 371 of third left handed trapezoidal shaped side panel 370 and along its right hand edge 382 of length L to the left hand edge 312 of first rectangular side panel 310, to form an eight side perimeter enclosure having interior dihedral angles of 135°. Third right handed trapezoidal shaped side panel 380 further has a bottom edge 383 of length w and a top inclined edge 384 of length r.

The roof of the eight sided irregular polyhedron building/structure 300 is constructed using two right handed trapezoidal shaped closure panels, two left handed trapezoidal shaped closure panels, all of which having a face angle, E, of 24.470° and a single rhombus shaped closure panel having a pair of opposing major face angles, F, of 114.470° and a pair of opposing minor face angles, G, of 65.530°.

A first left handed trapezoidal shaped closure panel 410 is attached along its perpendicular bottom edge 414 of length w to the top edge 314 of first rectangular side panel 310. First left handed trapezoidal shaped closure panel 410 further has a right hand edge 411 of length 1, a left hand edge 413 of length L, and a top inclined edge 412 of length r.

Rhombus shaped closure panel 420 is next attached along a first edge 421 of length r, which is here equal to length 1, to the right hand edge 411 of first left handed trapezoidal shaped closure panel 410. Rhombus shaped closure panel 420 is also attached along a fourth edge 424 and a second edge 422, both being of length r, to the top inclined edges 324 and 334 of first left and right handed trapezoidal shaped side panels 320 and 330.

A first right handed trapezoidal shaped closure panel 430 is attached along its bottom perpendicular edge 434, being of length w, to the top edge 344 of second rectangular side panel 340, and further along its left hand edge 433 of length 1 to the third edge 423 of rhombus shaped closure panel 420. First right handed trapezoidal shaped closure panel 430 further has a right hand edge 431 of length L and a top inclined edge 432 of length r which is attached along its length to the top inclined edge 412 of first left handed trapezoidal shaped closure panel 410.

A second right handed trapezoidal shaped closure panel 440 is attached along its top inclined edge 444 of length r to the top inclined edge 354 of second left handed trapezoidal shaped side panel 350. Second right handed trapezoidal shaped closure panel 440 is also attached along its right hand edge 441 of length L to the right hand edge 431 of first right handed trapezoidal shaped closure panel 430. Second right handed trapezoidal shaped closure panel 440 further has a left hand edge 442 of length 1, which is here equal to r, attached along the top inclined edge 364 of second right handed trapezoidal shaped side panel 360. As with all the trapezoidal shaped side and closure panels of the eight sided embodiment, second right handed trapezoidal shaped closure panel 440 has a bottom perpendicular edge 443 of given length w.

Finally, a second left handed trapezoidal shaped closure panel 450 is attached along right hand edge 454 of length 1 and along top inclined edge 452 of length r to the top inclined edges 374 and 384 of third left handed trapezoidal shaped side panel 370 and third right handed trapezoidal shaped side panel 380. Second left handed trapezoidal shaped closure panel 450 is further attached along its left hand edge 451 of length L to the left hand edge 413 of first left handed trapezoidal shaped closure panel 410 and along its bottom perpendicular edge 453 to the bottom perpendicular edge 443 of second right handed trapezoidal closure panel 440, thereby completing the eight sided irregular polyhedron building/structure 300.

Figure 9A:
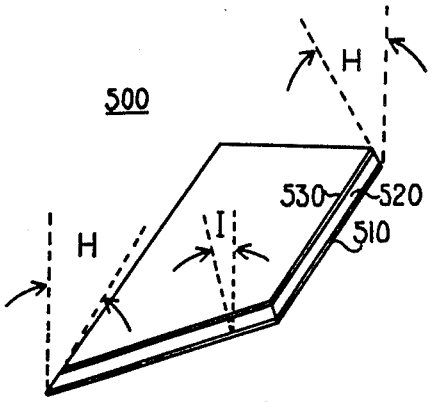
FIG. 9*a* is an elevation view of a typical trapezoidal side panel demonstrating the beveled edges.
Figure 9B:
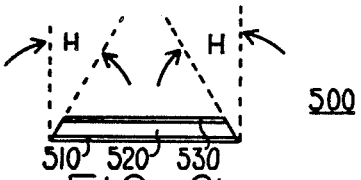
FIG. 9*b* is a bottom end view of a typical trapezoidal side panel.

Referring now to FIGS. 9*a* and 9*b*, a typical building panel 500 is shown. Typical building panel 500 is generally constructed from three laminated layers, here exterior layer 510, such as an exterior siding, a middle insulating layer 520, such as two or four inch polystyrene bead insulation sheets, and interior layer 530, such as plywood or wall board. For a given building/structure, such as the eight side irregular polyhedron building/structure, each panel's side edges are beveled to a uniform bevel here designated H. For the eight sided structure, H is equal to 22.5°, while for the ten sided structure H is equal to 18°. The top and bottom edge bevels, here designated as I, vary from panel to panel.

Figure 10:
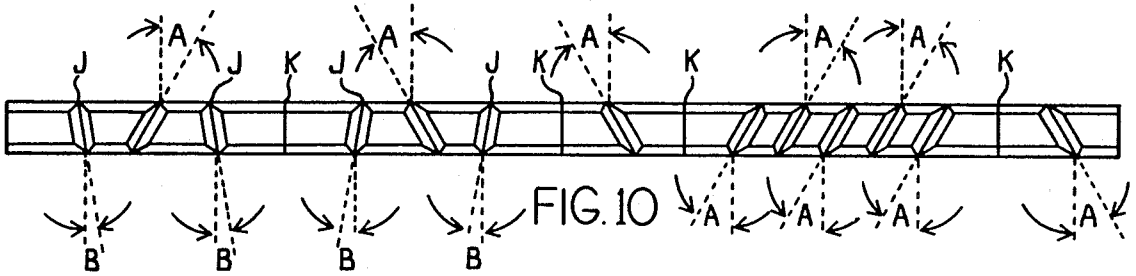
FIG. 10 is a production sequence layout for the ten sided irregular polyhedron building structure.

Referring now to FIG. 10, the production layout sequence for the 10 sided structure is shown. With the exception of the top and bottom edge bevels designated as J and K, all top and bottom edge bevels for the ten sided structure are equal to 18°, as is measured from vertical. The top and bottom edge bevels designated as J are equal to 30° while the edge bevels K are equal to 0° which corresponds to a vertical or perpendicular cut. FIG. 10 represents a single sequence which corresponds to a complete 18 panel set for a ten sided irregular polyhedron building/structure.

Figure 11:
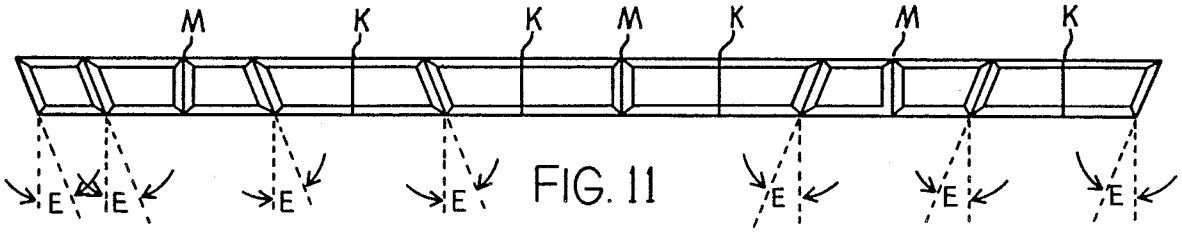
FIG. 11 is a production sequence layout for the eight sided irregular polyhedron building structure.

FIG. 11 shows the production sequence layout for an eight sided irregular polyhedron building/structure. Here side edge bevels, H, are generally 22.5° while the top and bottom edge bevels, with the exceptions of those designated with M and K are also 22.5°. Edge bevels M are here 32.765° while edge bevels K are again 0°. FIG. 11 shows a complete 13 panel sequence where a second or succeeding panel set is cut in reverse order and is a mirror image of the first set, such that the cycle repeats itself every other sequence.

Figures 12, 13:
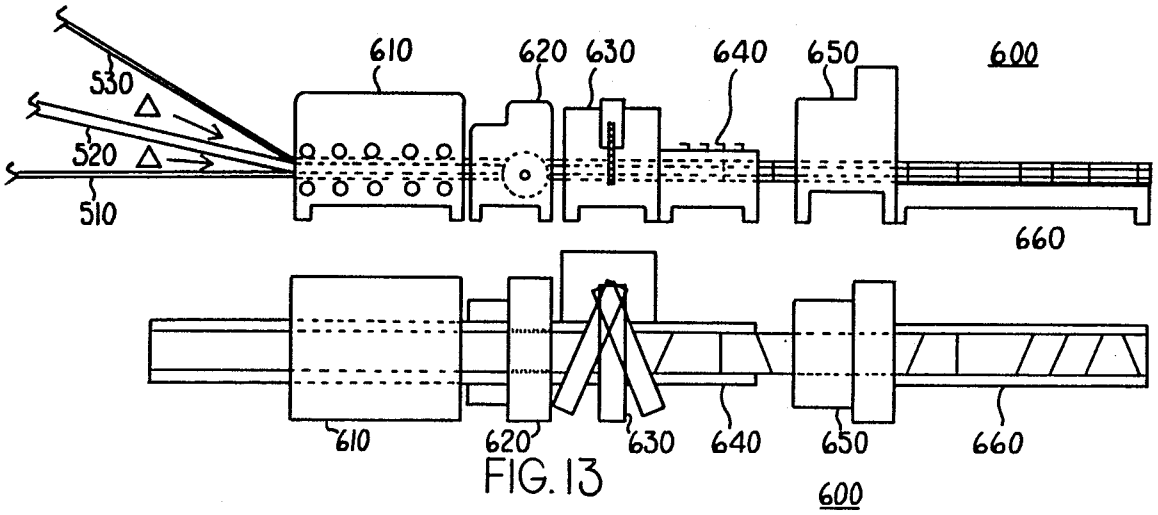
FIG. 12 is a side plan view of an automated continuous production line for the manufacture of the eight and ten sided irregular polyhedron building structures.
FIG. 13 is a top plan view of the production line.

Referring now to FIGS. 12 and 13, a representative diagram of an automated continuous production and manufacturing line 600 is shown in side and top view. The three panel layers, 510, 520, and 530 are fed into a radio frequency laminating press 610 which laminates the three layers together. Radio frequency radiation is used to expediently cure the laminating glue. The laminated stock is manufactured continuously by joining successive sheets of layered stock by finger joints or the like.

The continuous layered stock is then fed into a continuous side cutter 620 which trims the continuous stock to a uniform width and cuts any necessary side edge bevels. An automatic traveler double cut saw 630 is then used to cut the top and bottom beveled edges. Automatic traveler double cut saw 630 can either travel along with the production flow to insure a straight line cut, or the production flow can be temporarily stopped during the top and/or bottom edge cuts. If the latter is the case, an auto-stop indexing or registration system 640 is used to temporarily halt the production flow. In either case, automatic traveler double cut saw 630 is programed with the necessary face angle and edge bevels for the current and succeeding panel sets.

The individual building panels are then fed into a Bistronic, i.e. a programmable router 650, which is programed to cut out any desired doors, skylights, windows, or the like. The finished panels are then transported to packaging by finished panel conveyer 660.

I claim:

1. A ten sided polyhedron building structure for automated continuous production and manufacture which comprises:

three small right handed trapezoidal shaped side panels each having a top inclined edge of length T and a pair of parallel side edges, right hand edge of length Y and left hand edge of length Z, where Y is greater than Z and where said right and left hand edges are separated by a given width, say w;

three small left handed trapezoidal shaped side panels each having a top inclined edge of length T and a pair of parallel side edges, left hand edge of length Y and right hand edge of length Z, where Y is greater than Z and where said right and left hand edges are separated by said given width w;

two large right handed trapezoidal shaped side panels each having a top inclined edge of length t, where t is less than T, and a pair of parallel side edges, right hand edge of length X and left hand edge of length Y, where X is greater than Y and where said right and left edges are separated by said given width;

to large left handed trapezoidal shaped side panels each having a top inclined edge of length t and a pair of parallel side edges, left hand edge of length X and right hand edge of length Y, where said right and left edges are separated by said given width say w;

said side panels being vertically oriented wherein a first small right handed trapezoidal shaped side panel is joined along its right edge to the left hand edge of a first large right handed trapezoidal shaped side panel such that said first small right handed trapezoidal shaped side panel and said first large trapezoidal shaped side panel form a 144° dihedral angle there between;

wherein a first large left handed trapezoidal shaped side panel is joined along its left hand edge to the right hand edge of said first large right handed trapezoidal shaped to form a 144° dihedral angle there between;

wherein a first small left handed trapezoidal shaped side panel is joined along its left hand edge to the right hand edge of said first large left handed trapezoidal shaped side panel to form a 144° dihedral angle there between;

wherein a second small right handed trapezoidal shaped side panel is joined along its left hand edge to the right hand edge of said first small left handed trapezoidal shaped side panel to form a 144° dihedral angle there between;

wherein a second large right handed trapezoidal shaped side panel is joined along its left hand edge to the right hand edge of said second small right handed trapezoidal shaped side panel to form a 144° dihedral angle there between;

said third small right handed trapezoidal shaped side panel and along its right edge to the left edge of said first small right handed trapezoidal shaped side panel to form a ten sided enclosure having interior dihedral angles of 144°;

two right handed trapezoidal shaped closure panels each having a top inclined edge of length T and a bottom inclined edge of length t and a pair of parallel side edges, right hand edge of length V and left hand edge of length T, where V is greater than T and where said right and left edges are separated by said given width;

two left handed trapezoidal shaped closure panels each having a top inclined edge of length T and a bottom inclined edge of length t and a pair of parallel side edges, left hand edge of length V and right hand edge of length T, where said right and left edges are separated by said given width;

four rhombus shaped closure panels each having four equal length edges of length T and a pair of major interior face angles and a pair of minor interior face angles;

said closure panels being attached to said side panels wherein a first rhombus shaped closure panel is attached along a first and a second edge to the top inclined edges of said first small right handed trapezoidal shaped side panel and of said third small left handed trapezoidal shaped closure panel;

a first right handed trapezoidal shaped closure panel is attached along its bottom inclined edge to the top inclined edge of said first large right handed trapezoidal shaped side panel and further along its left hand edge to a third edge of said first rhombus shaped closure panel;

a first left handed trapezoidal shaped closure panel is attached along its bottom inclined edge to the top inclined edge of said first large left handed trapezoidal shaped side panel and further along its left hand edge to the right hand edge of said first right handed trapezoidal shaped closure panel;

a second rhombus shaped closure panel is attached along a first and a second edge to the top inclined edges of said second small left handed trapezoidal shaped closure panel and said second small right handed trapezoidal shaped side panel and further along a fourth edge to the right hand edge of said first left handed trapezoidal shaped closure panel;

a second right handed trapezoidal shaped closure panel is attached along its bottom inclined edge to the top inclined edge of said second large right handed trapezoidal side panel and along its left hand edge to a third edge of said second rhombus shaped closure panel and further attached along its top inclined edge to the top inclined edge of said first left handed trapezoidal closure panel;

a second left handed trapezoidal closure panel is attached along its bottom inclined edge to the top inclined edge of said second large left handed trapezoidal shaped side panel and along its left hand edge to the right hand edge of said second right handed trapezoidal shaped closure panel;

a third rhombus shaped closure panel is attached along a first and a second edge to the top inclined edges of said second small left handed trapezoidal shaped side panel and said second small right handed trapezoidal shaped side panel and further along a third edge to the right hand edge of said second left handed trapezoidal shaped closure panel;

a fourth rhombus shaped closure panel is attached along its first and second edges to the top inclined edges of said second left handed trapezoidal shaped closure panel and said first right handed trapezoidal shaped closure panel respectively, and further along its third and fourth edges to the third fourth edges of said first and third rhombus shaped closure panels.

2. An eight sided polyhedron building structure for automated continuous production and manufacture, which comprises:

three right handed trapezoidal shaped side panels each having a top inclined edge of length r and a pair of parallel edges being a right hand edge of length L and a left hand edge of length l, separated by a given width, wherein L is longer than l;

three left handed trapezoidal shaped side panels each having a top inclined edge of length r and a pair of parallel edges, being a left hand edge of length L and a right hand edge of length l, separated by said given width;

two rectangular side panels having top and bottom edges being of said given width, and parallel left and right side edges equal in length to L;

said side panels being vertically oriented wherein a first rectangular side panel is joined along its right edge to the left edge of a first left handed trapezoidal side panel such that said first rectangular side panel and said first left handed trapezoidal side panel form a 135° dihedral angle there between;

wherein a first right handed trapezoidal side panel is joined along its left hand edge to the right hand edge of said first left handed trapezoidal side panel to form a 135° dihedral angle there between;

wherein a second rectangular side panel is joined along its left hand edge to the right edge of said first right handed trapezoidal side panel to form a 135° dihedral angle there between;

wherein a second left handed trapezoidal side panel is joined along its left hand edge to the right hand edge of said second rectangular side panel to form a 135° dihedral angle there between;

wherein a second right handed trapezoidal side panel is joined at its left hand edge to the right hand edge of said second left handed trapezoidal side panel to form a 135° dihedral angle there between;

wherein a third left handed trapezoidal side panel is joined along its left edge to the right edge of said second right handed trapezoidal shaped closure panel to form a 135° dihedral angle there between; and wherein a third right handed trapezoidal panel is joined along its left edge to the right edge of said third left handed trapezoidal panel and along its right hand edge to the left hand edge of said first rectangular side panel to form an eight sided enclosure having interior dihedral angles of 135°;

two left handed trapezoidal shaped closure panels each having a top inclined edge of length r, a pair of parallel side edges being a left hand edge of length L and a right hand edge of length l, where l is equal to r, and a bottom edge of said given width being perpendicular to both said side edges;

two right handed trapezoidal shaped closure panels each having a top inclined edge of length r, a pair of parallel side edges being a right hand edge of length L and a left hand edge of length l, and a bottom edge of said given width being perpendicular to both said side edges;

a rhombus shaped closure panel having four sides of length r and a pair of opposing major face angles and a pair of opposing minor face angles; and said closure panels being attached to each other and to said side panels wherein a first left handed closure panel is attached along its bottom edge to the top edge of said first rectangular side panel;

said rhombus shaped closure panel is attached along two sides defining one of its opposing major interior angles to the top edges of said first left and right handed trapezoidal side panels and along a third side to the right edge of said first left handed trapezoidal closure panel;

a first right handed trapezoidal closure panel is attached along its bottom edge to the top edge of said second rectangular side panel, along its top edge to the top edge of said first left handed trapezoidal closure panel, and further along its left edge to the fourth edge of said rhombus shaped closure panel;

a second right handed closure panel is attached along its top inclined edge to the top inclined edge of said second left handed trapezoidal side panel while its right hand edge is attached along the right hand edge of said first right handed closure panel and its left hand edge is attached to the top inclined edge of said second right handed trapezoidal side panel; and a second left handed trapezoidal closure panel is attached at its top inclined edge to the top inclined edge of said third right handed trapezoidal side panel and along its right hand edge to the top inclined edge of said second left handed trapezoidal side panel and along its left hand edge to the left hand edge of said first left handed trapezoidal closure panel and finally along its bottom edge to the bottom edge of said second right handed trapezoidal closure panel.

* * * * *